US009321160B2

(12) United States Patent
Hered

(10) Patent No.: US 9,321,160 B2
(45) Date of Patent: Apr. 26, 2016

(54) SPRING TOOL AND METHOD OF USE FOR INSTALLING A SPRING ON A PART

(71) Applicant: BAKER HUGHES INCORPORATED, Houston, TX (US)

(72) Inventor: William A. Hered, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 225 days.

(21) Appl. No.: 14/101,651

(22) Filed: Dec. 10, 2013

(65) Prior Publication Data

US 2015/0158159 A1 Jun. 11, 2015

(51) Int. Cl.

| | |
|---|---|
| ***B25B 7/02*** | (2006.01) |
| ***B25B 27/30*** | (2006.01) |
| ***B25B 7/10*** | (2006.01) |

(52) U.S. Cl.

CPC ..... *B25B 27/306* (2013.01); *B25B 7/02* (2013.01); *B25B 7/10* (2013.01); *Y10T 29/4987* (2015.01); *Y10T 29/53622* (2015.01)

(58) Field of Classification Search

CPC ..... B25B 27/306; B25B 7/10; B25B 7/02; B25B 27/205; B25B 27/04; Y10T 29/4987; Y10T 29/53622

See application file for complete search history.

(56) References Cited

U.S. PATENT DOCUMENTS

| | | | | |
|---|---|---|---|---|
| 197,717 | A | 12/1877 | Caldwell | |
| 289,600 | A | 12/1883 | Barbour | |
| 362,981 | A | 5/1887 | Leslie | |
| 383,970 | A | 6/1888 | McHenry | |
| 436,706 | A | 9/1890 | Halstead | |
| 477,005 | A | 6/1892 | Heard | |
| 491,728 | A | 2/1893 | Miller | |
| 761,151 | A * | 5/1904 | Cummings | B25B 25/005 24/68 D |
| 1,011,806 | A | 12/1911 | Jordan | |
| 1,153,674 | A * | 9/1915 | Campbell | B25B 27/12 29/223 |
| 1,681,662 | A * | 8/1928 | Douglass | B25B 27/12 29/224 |
| D183,706 | S | 10/1958 | Simmons | |
| 4,610,187 | A * | 9/1986 | Spaulding | B25B 25/005 140/93.4 |
| D561,899 | S | 2/2008 | Golden | |
| 2010/0071514 | A1* | 3/2010 | Idir | B25B 25/005 81/9.3 |

* cited by examiner

*Primary Examiner* — Sarang Afzali
*Assistant Examiner* — Ruth G Hidalgo-Hernande
(74) *Attorney, Agent, or Firm* — Parsons Behle & Latimer

(57) ABSTRACT

A spring tool having a first arm pivotably and slidably connected to a second arm. The lower ends of the both the first and second arms are adapted to selectively retain an end of a spring so that the tool may be used to install an energized spring onto a part. The first arm includes a lower end having a window that the lower end of the second arm may pass through. The upper ends of the arms may be manipulated to pivot about a pivot point moving the lower ends of the arms together energizing a spring connected to the arms. The ends of the spring may become overlapped as the lower end of the second arm passes through the window. One arm may be moved upwards with respect to the other arm to make it easier to connect the overlapping ends of the spring around a part.

7 Claims, 3 Drawing Sheets

SPRING TOOL AND METHOD OF USE FOR INSTALLING A SPRING ON A PART

FIELD OF THE DISCLOSURE

The embodiments described herein relate to a tool and method for the installation of an energized spring onto a part.

BACKGROUND

Description of the Related Art

Springs are often installed onto a part in an energized state. For example, an extension spring may need to be stretched around a part with the ends of the spring connected together. As the springs are installed, the installer must be able to grip onto each end of the spring and also apply the appropriate force to stretch the spring and connect the ends of the springs together. The closer the ends of the spring get together, the more force is required to simply retain the ends of the springs within the grasp of the installer. Further, the force increases as one continues to stretch the ends of the spring together. Other drawbacks may exist. For example, sometimes an end of the spring may slip out of the grasp of the installer that causes the process to be started over. There is a potential of injury due to the energized nature of the spring being released. It would be beneficial to reduce the chance that an end of a spring would be accidentally released during the installation of an energized spring.

SUMMARY

The disclosure is directed to an apparatus and method that may overcome some of the problems or disadvantages discussed above. One embodiment is a spring tool comprising a first arm having a first end and a second end, the first end of the first arm comprising a handle. The tool includes a first member having a first end and a second end, the first end of the first member being connected to the second end of the first arm. The tool includes a second member having a first end and a second end, the first end of the second member being connected to the second end of the first arm. The tool includes a connecting member being connected between the second end of the first member and the second end of the second member, wherein the first member and the second member form a window having a first width. The tool includes a second arm having a first end and a second end, the first end of the second arm comprising a handle, wherein the first arm and the second arm are pivotably connected together. The tool includes a first prong connected to the second end of the second arm and a second prong connected to the second end of the arm, the second prong is positioned a second width from the first prong, wherein the second width is less than the first width.

The first and second arms of the tool may be slidably connected together. The tool may include a connecting member pivotably connecting the first arm to the second arm, the connecting member being positioned within an aperture of the first arm and a slot of the second arm, wherein the connecting member may be moved along the slot to change the position of the first arm with respect to the second arm. The first and second prongs of the tool may be adapted to move through the window of the first arm. The tool may include a third prong connecting to the first prong and a fourth prong connected to the second prong, the first prong having a length longer than a length of third prong and the second prong having a length longer than a length of the fourth prong. The tool may include a gap between the first prong and the second prong, the gap being coincident with a centerline of second arm.

One embodiment may be a method of connecting a spring on a part comprising positioning a spring around a portion of a part, connecting a first spring end to a first arm end of a tool, and connecting a second spring end to a second arm end of the tool. The method includes moving the first arm end and the second arm end towards each other, moving the second arm end through a portion of the first arm end, and connecting the first spring end to the second spring end. The first arm may be pivotably and slidably connected to the second arm.

The method may further comprise sliding the first arm with respect to the second arm prior to connecting the first spring end to the second spring end. A connector may be positioned within a slot in the second arm to pivotably connect the first arm to the second arm and the step of sliding the first arm with respect to the second arm may comprise moving the connector along the slot. The connector may be moved along the slot in a direction towards the handle of the second arm. Prior to positioning the spring around the portion of the part, the first spring end may be connected to the first arm end of the tool and the second spring end may be connected to the second arm end of the tool. Connecting the first spring end to the first arm end may comprise connecting the first spring end around a connecting member that is connected between a first member and a second member, wherein the first and second members are connected to the first arm end forming a window. Connecting the second spring end to the second arm end may comprise connecting the second spring end around at least one prong connected to the second arm end. Moving the second arm end through the portion of the first arm end may comprise moving the at least one prong through the window formed by the first and second members.

One embodiment is a tool that comprises a first arm having a window at one end and a handle at the other end and a second arm having at least one prong at one end and a handle at the other end, wherein the at least one prong is adapted to fit within the window. The tool includes a connector connecting the first arm and the second arm, the first arm and second arm configured to pivot about the connector. The connector may be configured to slide and selectively shift a position of a pivot point of the first and second arms.

At least one prong of the tool may be configured to retain an end of a spring. The at least one prong may comprise a first prong having an upper member and a lower member, a second prong having an upper member and a lower member, and a gap between the first prong and the second prong. The first arm of the tool may comprise a first member, a second member, and a connecting member between the first and second member, the window being formed between the first and second members and wherein the connecting member is configured to retain an end of a spring.

Figure 2:
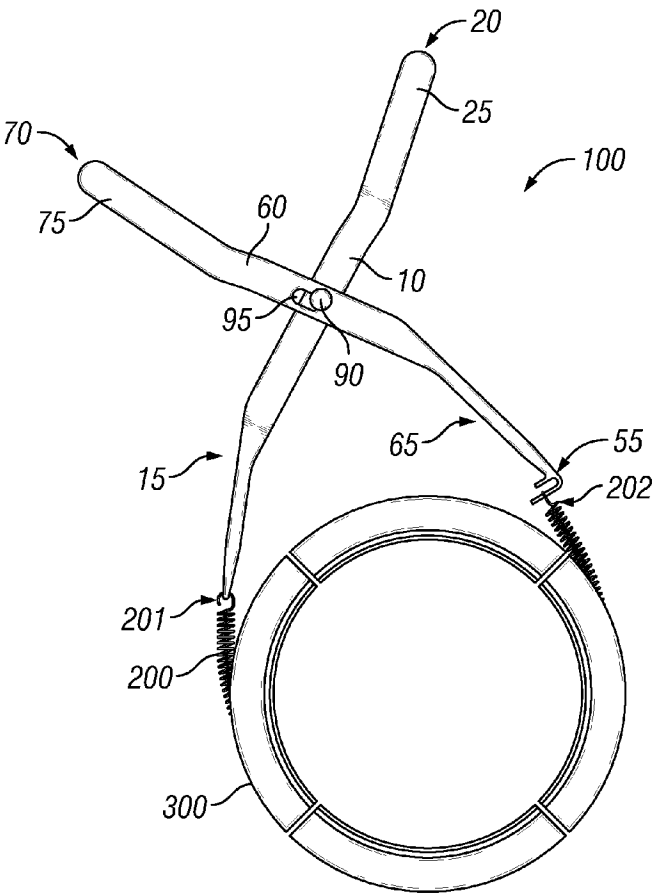
FIG. 2 shows an embodiment of a spring tool connecting a spring around a part.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

Figure 1:
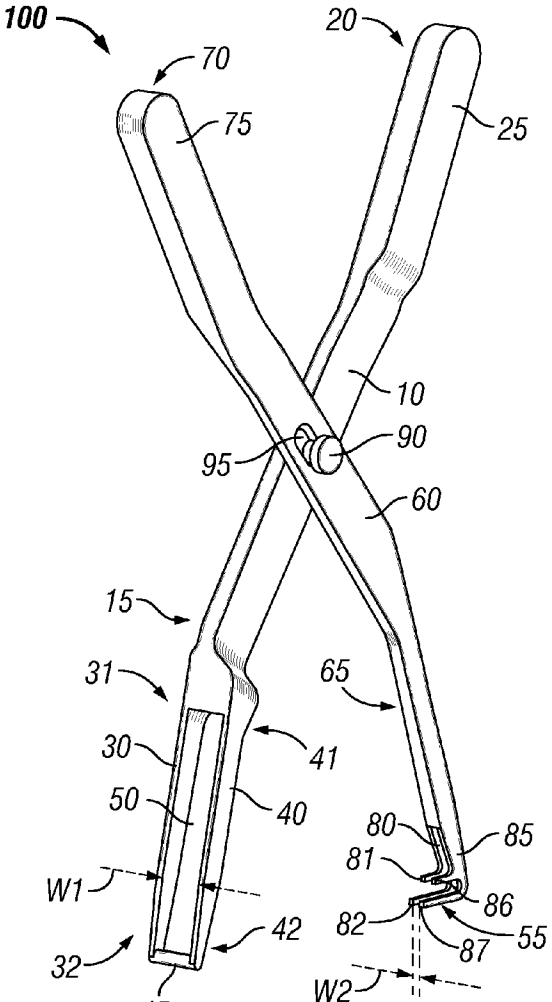
FIG. 1 shows an embodiment of a spring tool.

FIG. 1 shows a spring tool 100 that may be used to stretch a spring 200 (shown in FIG. 2) around a part 300 (shown in FIG. 2). The spring tool 100 may be a garter spring tool used to apply a garter spring around a part. The tool 100 includes a first arm 10 and a second arm 60 that are pivotably and slidably connected together. The first and second arms 10, 60 are connected together in a middle region of the arms 10, 60 via a pivoting pin or connector 90 that permit the arms to pivot about the pivoting pin 90. The arms act as pliers such that handles 75, 25 located at the upper or first ends 20, 70 of arms 10, 60 may be moved together moving the lower or second ends 15, 65 of the arms 10, 60 together. The second arm 60 includes a slot 95 that permits the sliding of the arms 10, 60 with respect to each other as will be discussed herein. The pivoting pin 90 is positioned within an aperture in the first arm 10 and is positioned within the slot 95 of the second arm 60. The pivoting pin 90 may be moved along the slot 95 permitting the movement of the arms 10, 60 with respect to each other as disclosed herein. Various mechanisms may be used to connect the arms 10, 60 together permitting the pivoting of the arms together as well as the sliding movement of the arms with respect to each other as would be appreciated by one of ordinary skill in the art having the benefit of this disclosure. For example, the slot and orientation of the pivoting pin could be reversed such that the slot could be within the first arm 10 instead of the second arm 60.

The lower ends 15, 65 of each arm 10, 60 are adapted to retain an end 201, 202 (shown in FIG. 2) of a spring 200 to facilitate the installation of a spring 200 (shown in FIG. 2) onto a part 300 (shown in FIG. 2). The tool 100 may be used to install various types of springs onto various types of parts other than those illustrated in the figures herein as would be appreciated by one of ordinary skill in the art having the benefit of this disclosure. A first member 30 and a second member 40 are connected to the lower end 15 of the first arm 10. Upper or first ends 31, 41 of the first and second members 30, 40 are connected to the lower end 15 of the first arm 10. A connecting member 45 is connected to the lower or second ends 32, 42 of the first and second members 30, 40. The connecting member 45 is adapted to selectively retain an end 201 of a spring 200 (shown in FIG. 2). The first and second members 30, 40 and connecting member 45 may be integral to the lower end 15 of the first arm 10 rather than being connected to the lower end 15 of the first arm 10 as would be appreciated by one of ordinary skill in the art having the benefit of this disclosure.

Prongs 55 adapted to retain one end 202 (shown in FIG. 2) of a spring 200 (shown in FIG. 2) may be connected to the lower end 65 of the second arm 60. The prongs 55 may include a first prong 80 and a second prong 85 that are spaced apart and both being connected to the lower end 65 of the second arm 60. The first prong 80 may include an upper prong 81 and a lower prong 82 having a longer length than the upper prong 81. The second prong 85 may include an upper prong 86 and a lower prong 87 having a longer length than the upper prong 86. The prongs 55 are configured to selectively retain an end 202 of a spring 200 while permitting the end 202 of the spring 200 to be slid off of the prongs 55 to be connected to the other end 201 of the spring 200 as is described herein. The configuration and number of prongs shown in FIG. 1 are for illustrative purposes and may be varied to selectively retain an end of a spring as would be appreciated by one of ordinary skill in the art having the benefit of this disclosure. For example, the prongs 55 may be integral with the lower end 65 of the second arm 60.

The lower end 15 of the first arm 10, the first member 30, the second member 40, and the connecting member 45 are configured to form a window 50 having a width W1. The width W1 is configured to permit the passage of the second end 65 of the second arm 60 and the prongs 55 through the window 50. The prongs 55 may have a width W2 that is less than the width W1 of the window 50. The passage of the prongs 55 into the window 50 permits the ends 201, 202 of the spring 200 to overlap each other providing for the easy attachment of the ends 201, 202 of the spring 200 together as discussed herein.

FIG. 2 shows a spring 200 partially positioned around a part 300 with the use of a spring tool 100. One end 201 of the spring 200 has been connected around the connecting member 45 of the lower end 15 of the first arm 10 and the other end 202 of the spring 200 has been connected to the prongs 55 of the lower end 65 of the second arm 55. The handles 25, 75 are positioned apart so that the ends 201, 202 of the spring 200 connected to the ends 15, 65 of the tool 100 are also positioned apart from each other. The spring 200 may first be partially positioned around the part 300 and then be the ends 201, 202 of the spring 200 may be connected to the tool 100. Alternatively, the ends 201, 202 of the spring 200 may be connected to the ends 15, 65 of the tool 100 and then the tool 100 may be used to partially position the spring 200 around the part 300 onto which the spring 200 is to be installed.

Figure 4:
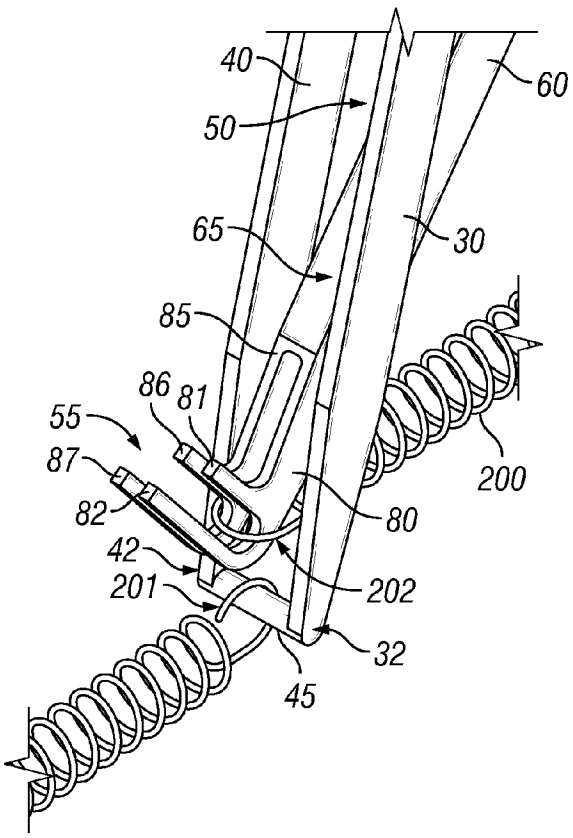
FIG. 4 shows a close up view of ends of an embodiment of a spring tool.
Figure 3:
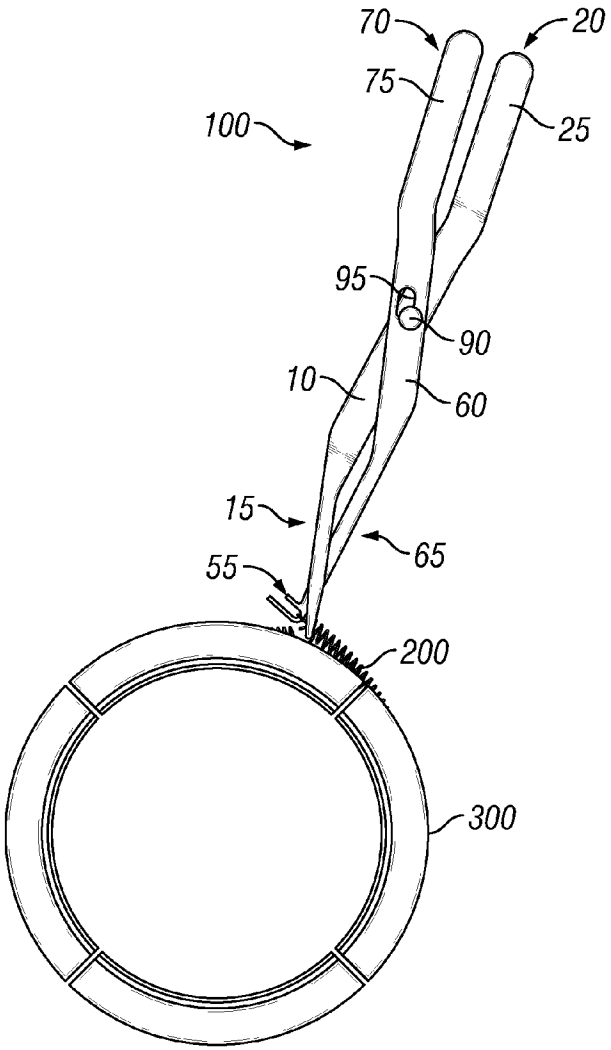
FIG. 3 shows an embodiment of a spring tool used to bring ends of a spring together around a part.

FIG. 3 shows the handles 25, 75 of the tool 100 positioned together to move the ends 201, 202 of the spring 200 to be adjacent to each other. The handles 25, 75 may be used to exert the force necessary to stretch the spring 200 around the part 300. As discussed above, manual exertion of a spring 200 to an energized positioned around a part 300 may be difficult. The pivoting of the arms 10, 60 of the tool 100 provides an easier mechanism to both stretch the spring 200 to an energized positioned and maintain the spring 200 in the energized position. As shown in FIG. 3 and FIG. 4, the prongs 55 of the second arm 60 are able to pass through the window 50 of the first arm 10 so that the end 202 of the spring 200 attached to the prongs 55 overlaps the end 201 of the spring 200 connected to the connecting member 45. FIG. 4 shows a close-up view of the end of the tool 100 with the prongs 55 passing through the window 50 of the first arm 10.

Figure 5:
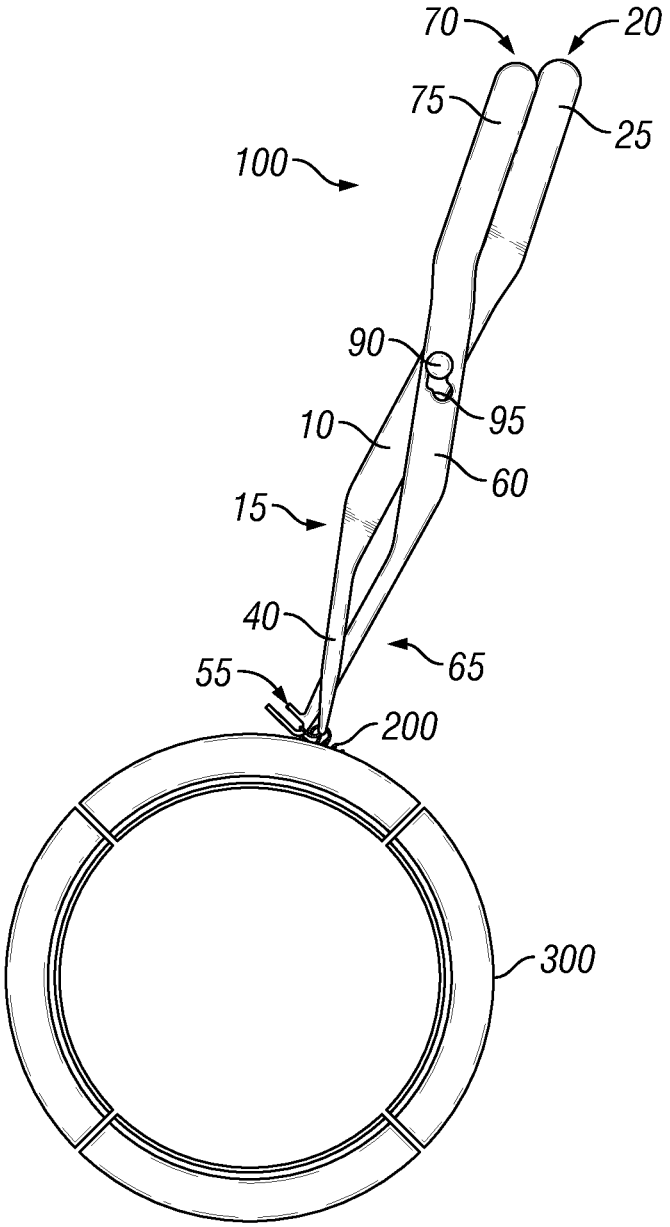
FIG. 5 shows an embodiment of a spring tool.

After the prongs 55 on the second end 65 of the second arm 60 have been positioned within the window 50, the first arm 10 may be shifted upwards causing the pivoting pin 90 to move along the slot 95 in the second arm 60 as shown in FIG. 5. This will bring the two ends 201, 202 of the spring 200 together making it easier to attach the two spring ends 201, 202 of the spring 200 together. The prongs 55 are configured to permit the end 202 of the spring 200 to be slid off the prongs 55 and be connected to the other end 201 of the spring 200. Now the spring 200 will be installed in an energized position around the desired part 300. The configuration of the part 300 is for illustrative purposes only. The disclosed tool 100 may be beneficial in the installation of various springs onto various parts as would be appreciated by one of ordinary skill in the art having the benefit of this disclosure.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

TABLE OF REFERENCE NUMERALS FOR FIGS. 1-5

| | |
|---|---|
| 10 | first arm of tool |
| 15 | one end of first arm |
| 20 | one end of first arm |
| 25 | handle on first arm |
| 30 | first member connected to first arm |
| 31 | one end of first member |
| 32 | one end of first member |
| 40 | second member connected to first arm |
| 41 | one end of second member |
| 42 | one end of second member |
| 45 | connecting member between first and second members |
| 50 | window between first and second members |
| 55 | prongs at end of second arm |
| 60 | second arm |
| 65 | end of second arm |
| 70 | end of second arm |
| 75 | handle on second arm |
| 80 | first prong |
| 81 | upper prong of first prong |
| 82 | lower prong of first prong |
| 85 | second prong |
| 86 | upper prong of second prong |
| 87 | lower prong of second prong |
| 90 | connector or pin |
| 95 | slot in second arm |
| 100 | tool |
| 200 | spring |
| 201 | end of spring |
| 202 | end of spring |
| 300 | part |

What is claimed is:

1. A method of connecting a spring on a part, the method comprising:

positioning a spring around a portion of a part;

connecting a first spring end to a first arm end of a tool;

connecting a second spring end to a second arm end of the tool, wherein the first arm is pivotably and slidably connected to the second arm;

moving the first arm end and the second arm end towards each other; moving the second arm end through a portion of the first arm end;

sliding the first arm with respect to the second arm prior to connecting the first spring end to the second spring end; and connecting the first spring end to the second spring end.

2. The method of claim 1, wherein connecting the first spring end to the first arm end further comprises connecting the first spring end around a connecting member that is connected between a first member and a second member, wherein the first and second members are connected to the first arm end forming a window.

3. The method of claim 2, wherein connecting the second spring end to the second arm end further comprises connecting the second spring end around at least one prong connected to the second arm end.

4. The method of claim 3, wherein moving the second arm end through the portion of the first arm end further comprises moving the at least one prong through the window formed by the first and second members.

5. The method of claim 1, wherein a connector positioned within a slot in the second arm pivotably connects the first arm to the second arm and sliding the first arm with respect to the second arm further comprising moving the connector along the slot.

6. The method of claim 5, wherein the connector is moved along the slot in a direction towards the handle of the second arm.

7. The method of claim 1, wherein prior to positioning the spring around the portion of the part the first spring end is connected to the first arm end of the tool and the second spring end is connected to the second arm end of the tool.

* * * * *